US011197510B2

(12) United States Patent
Pruett et al.

(10) Patent No.: US 11,197,510 B2
(45) Date of Patent: Dec. 14, 2021

(54) ACADEMIC HAT TASSEL SECURING SYSTEM

(71) Applicant: TassLoc LLC, Sioux Falls, SD (US)

(72) Inventors: Josh Pruett, Sioux Falls, SD (US); Amir Krdzalic, Sioux Falls, SD (US); Lindsey Yeauger, Dublin, OH (US); Gary Yeauger, Dublin, OH (US); Jason Lukacsko, Dublin, OH (US)

( * ) Notice: Subject to any disclaimer, the term of this patent is extended or adjusted under 35 U.S.C. 154(b) by 0 days.

(21) Appl. No.: 16/281,145

(22) Filed: Feb. 21, 2019

(65) Prior Publication Data

US 2020/0268086 A1 Aug. 27, 2020

(51) Int. Cl.

| | |
|---|---|
| ***A42B 1/24*** | (2021.01) |
| ***A44B 99/00*** | (2010.01) |
| ***A42B 1/004*** | (2021.01) |

(52) U.S. Cl.

CPC ..... *A42B 1/24* (2013.01); *A42B 1/004* (2013.01); *A44B 99/00* (2013.01)

(58) Field of Classification Search

CPC .. A42B 1/24; A42B 1/004; A42B 1/02; A42B 1/041; A42B 1/12; A42B 1/043; A42B 1/208; A42B 1/248; A42B 1/00; A44B 99/00; Y10T 24/1394

USPC ..... 223/46; 2/171.01, 171, 209.13, 200.3

See application file for complete search history.

(56) References Cited

U.S. PATENT DOCUMENTS

| | | | | |
|---|---|---|---|---|
| 8,545,041 | B2 * | 10/2013 | Brown | F21V 21/0885 362/191 |
| 2010/0079356 | A1 * | 4/2010 | Hoellwarth | G09G 5/14 345/8 |
| 2018/0020758 | A1 * | 1/2018 | Pruett | A42B 1/02 2/171.01 |
| 2019/0104689 | A1 * | 4/2019 | Barnes | A01G 5/04 |

* cited by examiner

*Primary Examiner* — F Griffin Hall

(57) ABSTRACT

An academic hat tassel securing system includes a mortarboard including a cap and a board attached to and positioned on top of the cap. The board has a planar top side and a perimeter edge having a square shape. The perimeter edge includes a front left edge, a right left edge, a rear left edge and a rear right edge. A tether has a first end coupled to the board and a second end coupled to a tassel such that the tether extends over the perimeter edge of the board. A securing members is removably attached to the board and the tether is releasably securable to the securing member such that the tether is retained in place relative to the board.

10 Claims, 5 Drawing Sheets

ACADEMIC HAT TASSEL SECURING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tassel securing devices and more particularly pertains to a new tassel securing device for retaining a tassel on a board of an academic hat in a proper position along the board's perimeter edge.

BRIEF SUMMARY OF THE INVENTION

An embodiment of the disclosure meets the needs presented above by generally comprising a mortarboard including a cap and a board attached to and positioned on top of the cap. The board has a planar top side and a perimeter edge having a square shape. The perimeter edge includes a front left edge, a right left edge, a rear left edge and a rear right edge. A tether has a first end coupled to the board and a second end coupled to a tassel such that the tether extends over the perimeter edge of the board. A securing members is removably attached to the board and the tether is releasably securable to the securing member such that the tether is retained in place relative to the board.

An embodiment of the disclosure also meets the needs by including a clip configured to removably securable to the board. The clip includes an end wall having a first side, a second side, a first lateral edge, a second lateral edge, an upper edge and a lower edge. The end wall is elongated from the first lateral edge to the second lateral edge. A pair of plates is integrally attached to and extends away from the first side of the end wall. Each of the plates has an outer surface and an inner surface wherein the inner surfaces face each other. The end wall and the plates are comprised of a resiliently flexible material. A catch is attached to the clip and is configured to releasably engage the tether. The catch includes an arm that is attached to the clip and extends laterally away therefrom. The arm has an attached end and a free end. The attached end is attached to the clip and the free end is configured to be abutted against the perimeter edge of the board such a receiving space for receiving the tether is defined between the arm and the perimeter edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
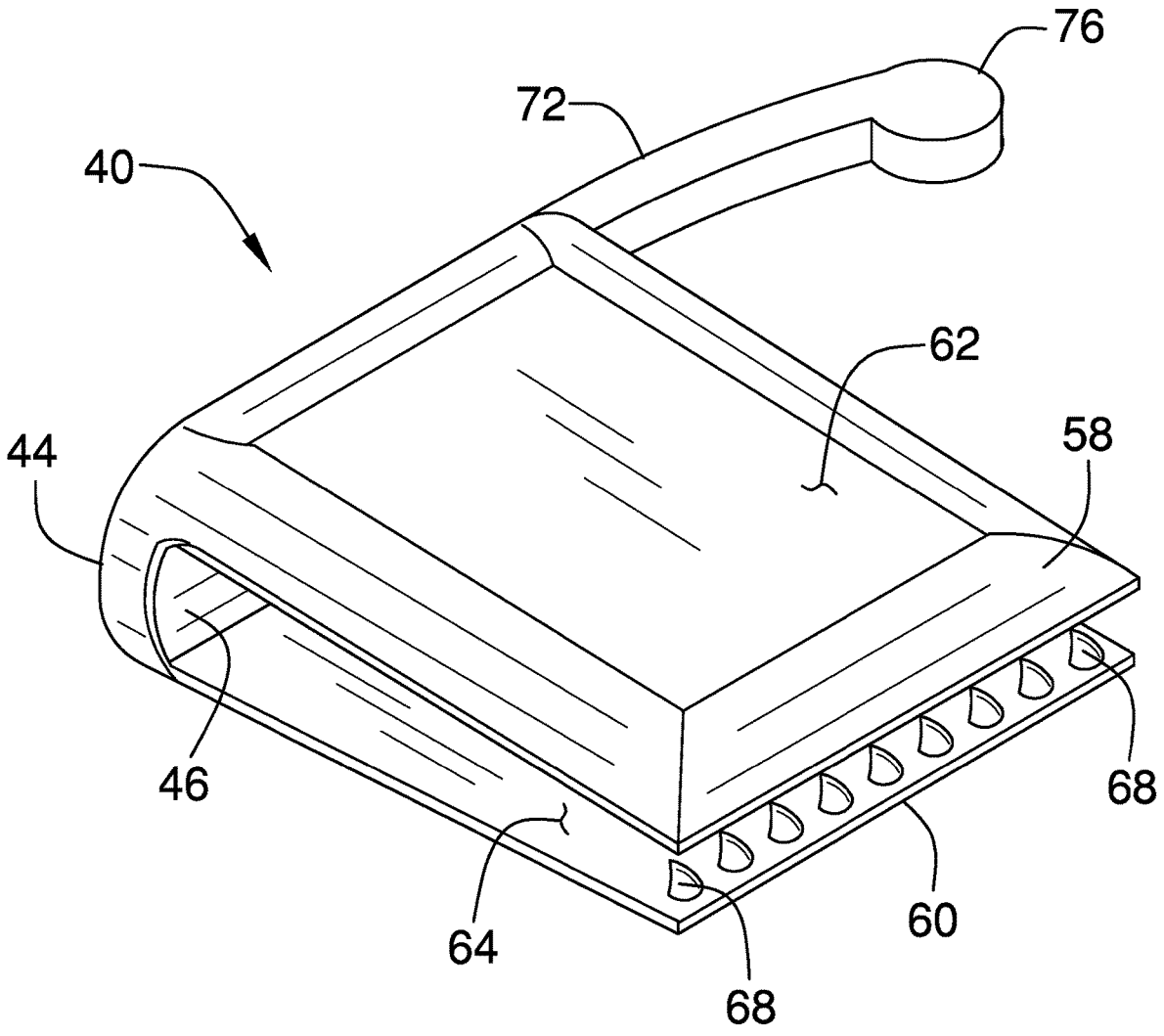
FIG. 1 is a front top isometric view of a academic hat tassel securing system according to an embodiment of the disclosure.
Figure 2:
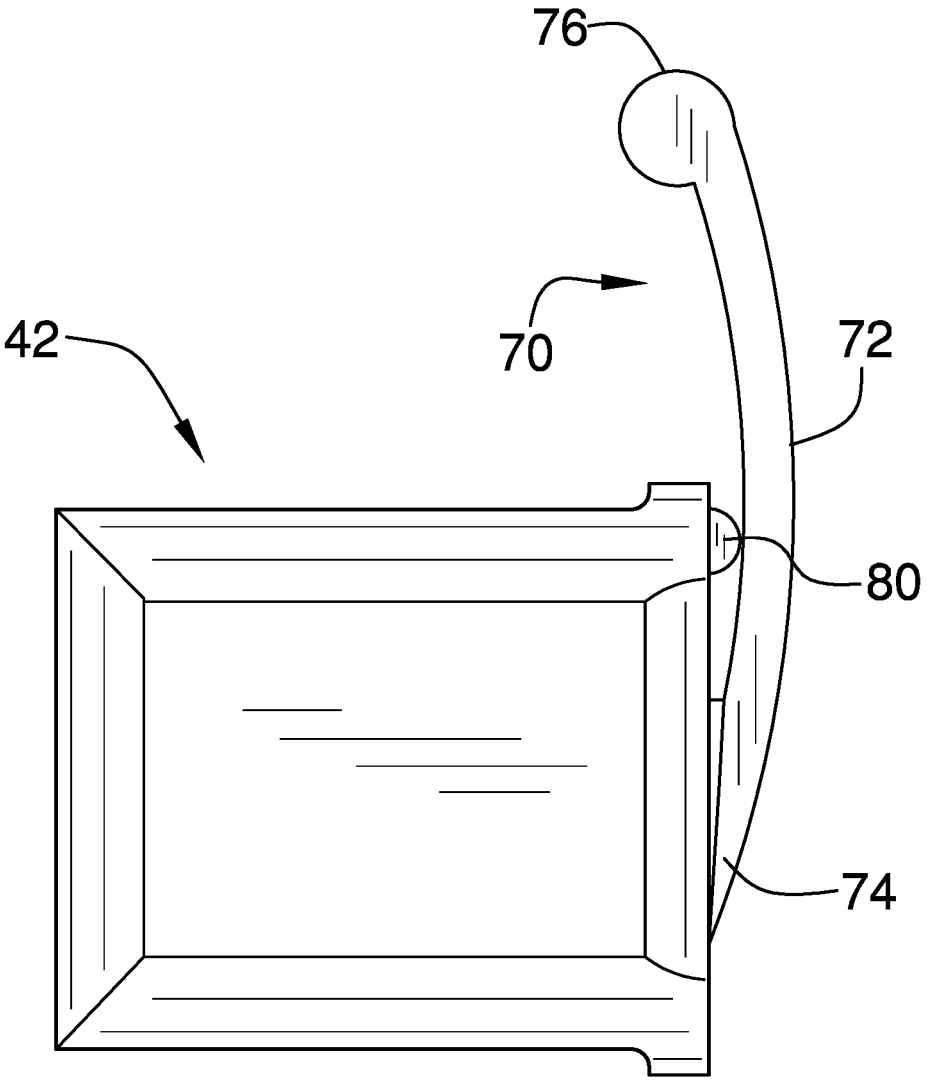
FIG. 2 is a bottom view of an embodiment of the disclosure.

With reference now to the drawings, and in particular to FIGS. 1 through 6 thereof, a new tassel securing device embodying the principles and concepts of an embodiment of the disclosure and generally designated by the reference numeral 10 will be described.

As best illustrated in FIGS. 1 through 6, the academic hat tassel securing system 10 generally comprises a mortarboard 12 including a cap 14 and a board 16 attached to and positioned on top of the cap 14. The board 16 has a planar top side 18 and a perimeter edge 20 having a square shape. The perimeter edge 20 includes a front left edge 22, a front right edge 24, a rear left edge 26 and a rear right edge 28 relative to a person wearing such. The mortarboard 12 is also commonly referred to as an academic hat used during graduation ceremonies. A tether 30 is usually provided which has a first end 32 coupled to the board 16, or a button 34 positioned on the board 16, and a second end 36 coupled to a tassel 38 such that the tether 30 extends over the perimeter edge 20 of the board 16.

Figure 6:
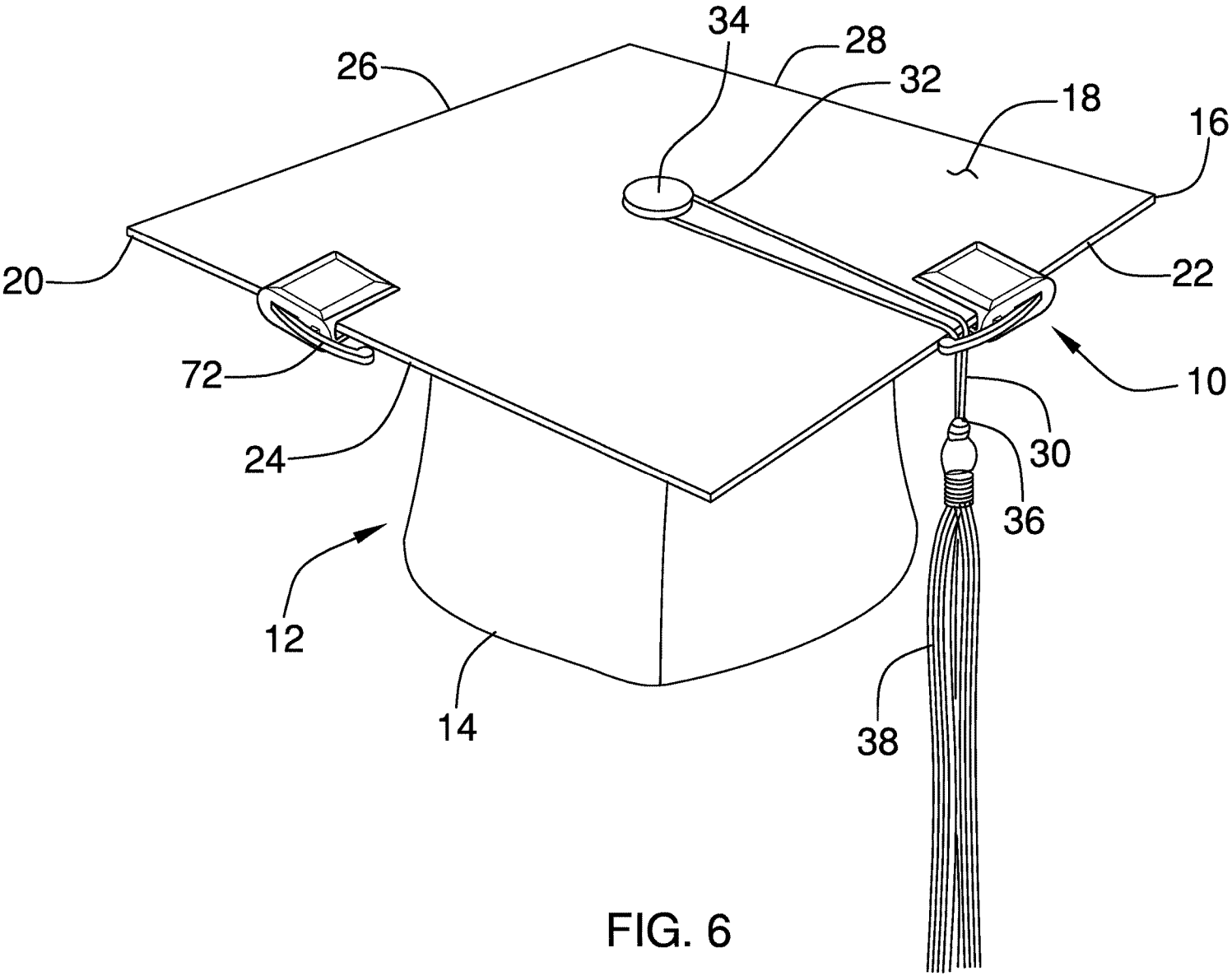
FIG. 6 is an isometric in-use view of an embodiment of the disclosure.

A securing member 40 is removably attached to the board 16, though, as can be seen in FIG. 6, a pair of securing members 40 may be, and typically will be, utilized. The tether 30 is releasably securable to one of the securing members 40 such that the tether 30 is retained in place relative to the board 16. One of the securing members 40 is positioned on the front right edge 24 and one of the securing members 40 is positioned on the front left edge 22.

Each of the securing members 40 comprises a clip 42 that is removably securable to the board 16. The clip 42 includes an end wall 44 which has a first side 46, a second side 48, a first lateral edge 50, a second lateral edge 52, an upper edge 54 and a lower edge 56. The end wall 44 is elongated from the first lateral edge 50 to the second lateral edge 52. The end wall 44 has a length from the first lateral edge 50 to the second lateral edge 52 between 0.75 inches and 1.25 inches and height from the upper edge 54 to the lower edge 52 between 0.20 inches and 0.50 inches.

Figure 3:
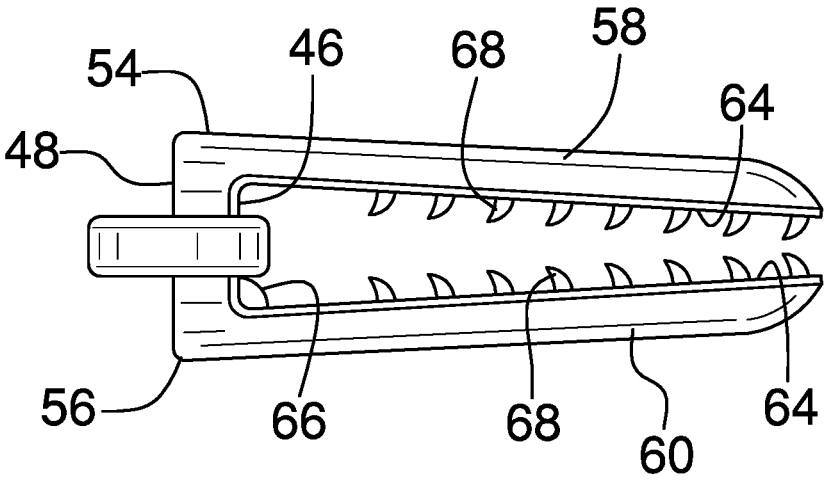
FIG. 3 is a side view of an embodiment of the disclosure.
Figure 4:
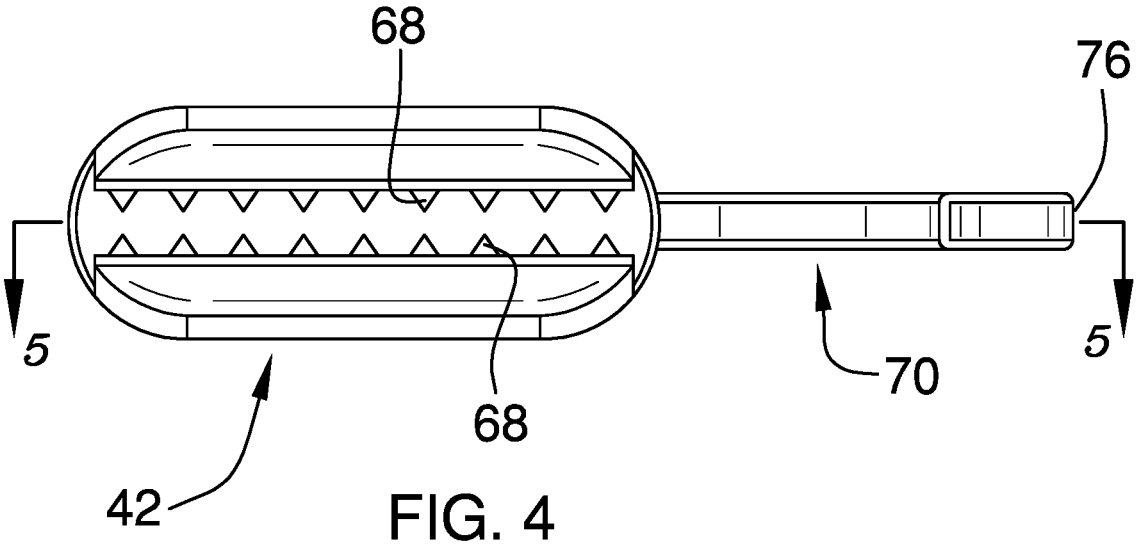
FIG. 4 is a front view of an embodiment of the disclosure.
Figure 5:
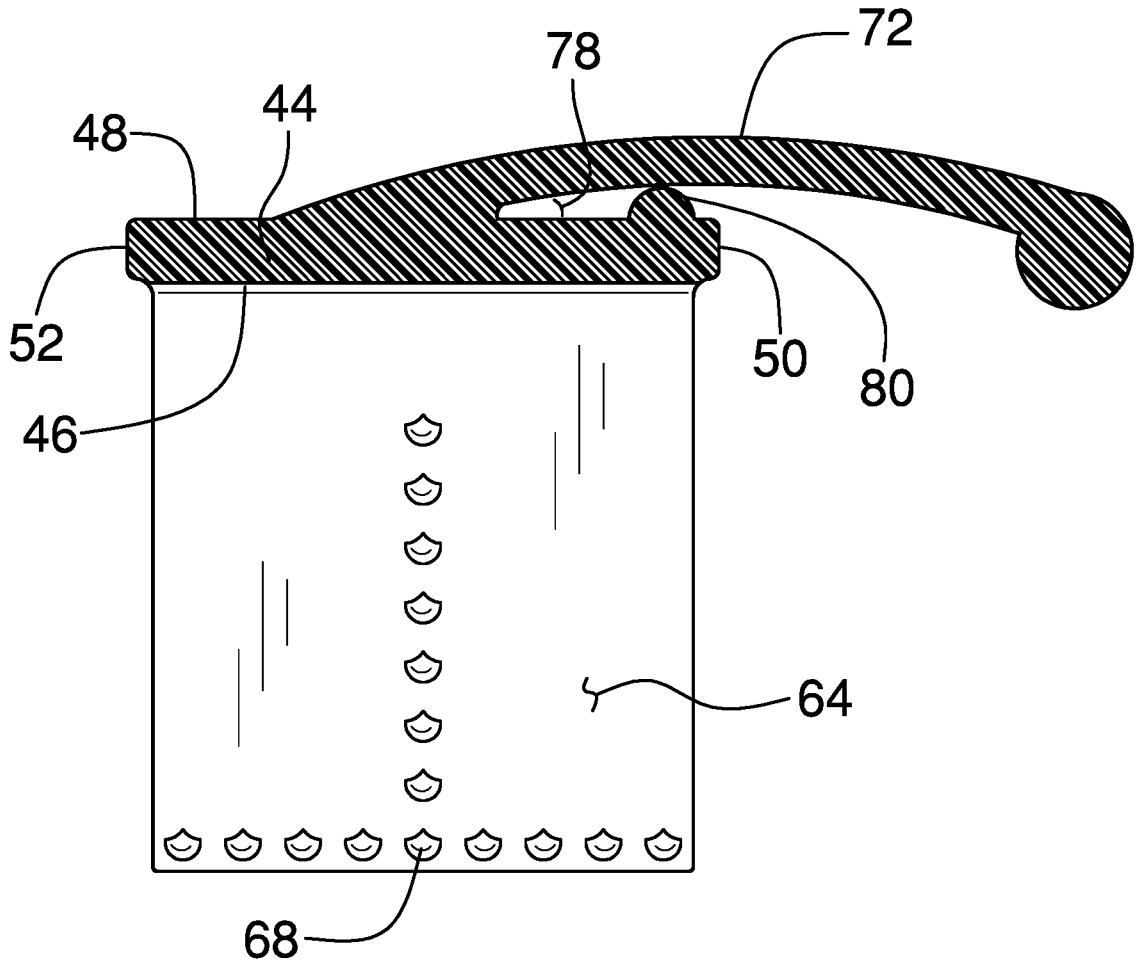
FIG. 5 is a cross-sectional view of an embodiment of the disclosure taken along line 5-5 of FIG. 4.

A pair of plates 58, 60 is integrally attached to and extends away from the first side 46 of the end wall 44, wherein one of the plates 58 extends along the upper edge 54 and one of the plates 60 extends along the lower edge 56. The term "integrally" is here meant to define as being non-removable from each other and may include a unitary structure. Each of the plates 58, 60 has an outer surface 62 and an inner surface 64 wherein the inner surfaces 64 face each other. The end wall 44 and the plates 58, 60 are comprised of a resiliently flexible material such as a plastic material through other materials, such as metallic materials may be utilized as well. The material retains the plates 58, 60 in a same position relative to each other such that plates 58, 60 are biased toward each other when forced apart such as when the board 16 is inserted between the plates 58, 60. The plates 58, 60 may be angled toward each other as the plates extend away from the end wall so that the plates form an acute angle 66 with the end wall 44 having a measurement between 70° and 90°. Each of the plates 58, 60 has length and width between 0.50 inches and 1.35 inches. A plurality of teeth 68 is positioned on the inner surfaces 64 of each of the plates 58, 60. The teeth 68 may be angled or curved toward the end wall as shown in FIG. 3.

A catch 70 is attached to the clip 42 and releasably engages the tether 30. The catch 70 includes an arm 72 that is attached to the clip 42 and extends laterally away therefrom. The arm 72 has an attached end 74 and a free end 76. The attached end 74 is attached to the clip 42 and the free end 76 is abuttable against the perimeter edge 20 such that a receiving space for receiving the tether 30 is defined between the arm 72 and the perimeter edge 20. The arm 72 lies within a plane that is bounded by horizontal planes of the upper 54 and lower 56 edges. The attached end 74 is positioned between the first 52 and second 50 lateral edges on the second side 48 of the end wall 44. The arm 72 forms an angle 78 with the end wall of less than 20° and extends in an arcuate path outwardly away from the second side 48 and toward the first lateral edge 50. The arm 72 extends beyond the first lateral edge 50 such that a line extending through the first 50 and second 52 lateral edges intersects the arm 72 adjacent to the free end 76. This allows the free end 76 to abut the perimeter edge 20 when the perimeter edge 20 abuts the end wall 44. The free end 76 has an arcuate, bulbous shape to prevent damage to the perimeter edge 20 and to easily slide the tether 30 between the perimeter edge 20 and the free end 76. A spacer 80 is mounted on the second side 48 between the attached end 74 and the first lateral edge 50. The spacer 80 extends away from the second side 48 a distance of less than 0.10 inches and the arm 72 abuts the spacer 80 to prevent the arm 72 from urging the clip 42 away from the perimeter edge 20.

In use, the securing members 40 are positioned on the board 16 as stated above and as shown in FIG. 6. During a graduation ceremony, the tassel 38 will hang from the front right edge 24 and then moved to the front left edge 22 after receiving a diploma. The securing members 40 ensure that the tassel 38 remains in place during a graduation ceremony and while pictures are taken both before and after the ceremony.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An academic hat and tassel securing system comprising:

a mortarboard including a cap and a board attached to and positioned on top of the cap, the board having a square shape, a planar top side and a perimeter edge, the perimeter edge including a front left edge, a front right edge, a rear left edge and a rear right edge;

a tassel;

a tether having a first end coupled to the board and a second end coupled to the tassel such that the tether extends over the perimeter edge of the board; and a securing member being removably attached to the board, the tether being releasably securable to the securing member such that the tether is retained in place relative to the board, wherein the securing member includes a clip, wherein the clip includes a pair of plates, each of the plates having an outer edge and an inner surface, the clip being removably securable to the board, on the inner surfaces of each of the plates; and a catch being attached to the clip and releasably engaging the tether, wherein the catch includes an arm being attached to the clip and extending laterally away therefrom, the arm having an attached end and a free end, the attached end being attached to the clip, the free end being abuttable against the perimeter edge such that a receiving space for receiving the tether is defined between the arm and the perimeter edge.

2. The academic hat and tassel securing system according to claim 1, wherein the clip includes: an end wall, the end wall having a first side, a second side, a first lateral edge, a second lateral edge, an upper edge and a lower edge, the end wall being elongated from the first lateral edge to the second lateral edge; the plates being integrally attached to and extending away from the first side of the end wall, wherein the inner surfaces face each other, the board being positionable between the pair of plates.

3. The academic hat and tassel securing system according to claim 2, wherein the end wall and the plates are comprised of a resiliently flexible material.

4. The academic hat and tassel securing system according to claim 3, wherein the plates are angled toward each other as the plates extend away from the end wall.

5. The academic hat and tassel securing system according to claim 4, further including a plurality of teeth being positioned on the inner surfaces of the first and second plates.

6. The academic hat and tassel securing system according to claim 2, further including a plurality of teeth being positioned on the inner surfaces of the first and second plates.

7. An academic hat and tassel securing system comprising: a mortarboard including a cap and a board attached to and positioned on top of the cap, the board having a square shape, a planar top side and a perimeter edge, the perimeter edge including a front left edge, a front right edge, a rear left edge and a rear right edge; a tassel; a tether having a first end coupled to the board and a second end coupled to the tassel such that the tether extends over the perimeter edge of the board; a securing member being removably attached to the board, the tether being releasably securable to the securing member such that the tether is retained in place relative to the board, wherein the securing member includes a cup, wherein the clip includes a pair of plates, each of the plates having an outer edge and an inner surface, the clip being removably securable to the board, on the inner surfaces of each of the plates, and a catch being attached to the clip and releasably engaging the tether; wherein the clip includes an end wall, the end wall having a first side, a second side, a first lateral edge, a second lateral edge, an upper edge and a lower edge, the end wall being elongated from the first lateral edge to the second lateral edge, and the plates being integrally attached to and extending away from the first side of the end wall, wherein the inner surfaces face each other, the board being positionable between the pair of plates; and wherein the catch includes an arm being attached to the clip and extending laterally away therefrom, the arm having an attached end and a free end, the attached end being attached to the the free end being abuttable against the perimeter edge such that a receiving space for receiving the tether is defined between the arm and the perimeter edge.

8. The academic hat and tassel securing system according to claim 7, wherein the attached end is positioned between the first and second lateral edges on the second side of the end wall, the arm forming an angle with the end wall of less than 20°, the arm extending in an arcuate path outwardly away from the second side and toward the first lateral edge, the arm extending beyond the first lateral edge such that a line extending through the first and second lateral edges intersects the arm adjacent to the free end.

9. The academic hat and tassel securing system according to claim 8, further including a spacer being mounted on the second side between the attached end and the first lateral edge, the arm abutting the spacer.

10. An academic hat and tassel securing system comprising:

a mortarboard including a cap and a board attached to and positioned on top of the cap, the board having a square shape, a planar top side and a perimeter edge, the perimeter edge including a front left edge, a front right edge, a rear left edge and a rear right edge;

a tassel;

a tether having a first end coupled to the board and a second end coupled to the tassel such that the tether extends over the perimeter edge of the board;

a pair of securing members being removably attached to the board, the tether being releasably securable to one of the securing members such that the tether is retained in place relative to the board, one of the securing members being positioned on the front right edge, one of the securing members being positioned on the front left edge, each of the securing members comprising:

a clip being removably securable to the board, the clip including:

an end wall, the end wall having a first side, a second side, a first lateral edge, a second lateral edge, an upper edge and a lower edge, the end wall being elongated from the first lateral edge to the second lateral edge;

a pair of plates being integrally attached to and extending away from the first side of the end wall, each of the plates having an outer surface and an inner surface wherein the inner surfaces face each other, the end wall and the plates being comprised of a resiliently flexible material, the plates being angled toward each other as the plates extend away from the end wall;

a plurality of teeth being positioned on the inner surfaces of each of the plates;

a catch being attached to the clip and releasably engaging the tether, the catch including an arm being attached to the clip and extending laterally away therefrom, the arm having an attached end and a free end, the attached end being attached to the clip, the free end being abuttable against the perimeter edge such that a receiving space for receiving the tether is defined between the arm and the perimeter edge, the attached end being positioned between the first and second lateral edges on the second side of the end wall, the arm forming an angle with the end wall of less than 20°, the arm extending in an arcuate path outwardly away from the second side and toward the first lateral edge, the arm extending beyond the first lateral edge such that a line extending through the first and second lateral edges intersects the arm adjacent to the free end, a spacer being mounted on the second side between the attached end and the first lateral edge, the arm abutting the spacer.

* * * * *